United States Patent [19]

Richilano

[11] 3,942,567

[45] Mar. 9, 1976

[54] CAST ALUMINUM ALLOY HAMMER

[75] Inventor: Vincent J. Richilano, Lakewood, Ohio

[73] Assignee: Zephyr Industries, Inc., Lakewood, Ohio

[22] Filed: Aug. 14, 1974

[21] Appl. No.: 497,272

[52] U.S. Cl. ..... 145/29 R; 145/36; 145/61 H

[51] Int. Cl.[2] ..... B25C 1/00; B25D 1/00

[58] Field of Search ..... 145/29 R, 29 B, 29 D, 36, 145/61 D, 61 H

[56] References Cited

UNITED STATES PATENTS

| | | | |
|---|---|---|---|
| 1,095,866 | 5/1914 | Horat | 145/36 UX |
| 1,603,904 | 10/1926 | Cohn | 145/36 UX |
| 1,669,701 | 5/1928 | Estwing | 145/29 R X |
| 3,130,762 | 4/1964 | Kerr | 145/36 X |
| 3,844,321 | 10/1974 | Cook | 145/36 X |

*Primary Examiner*—Al Lawrence Smith
*Assistant Examiner*—J. T. Zatarga
*Attorney, Agent, or Firm*—Fay & Sharpe

[57] ABSTRACT

A hammer cast in a sand mold of one piece including a head and a handle. The material of which it is cast is a magnesium aluminum alloy. Both the handle and head have axes which are normal to each other and a rod is mounted in the handle extending the length of the handle and completely through the head with the rod being essentially coaxial with the handle. Serrations formed in the rod enhance the anchoring of the alloy and the serrations are formed on the rod such that the plane passing through the axes of the handle and head does not pass through the serrations. The handle merges in a smooth curve into the head of the hammer, the merging surface defining a smooth concave exterior surface on the handle with no sharp angular edges.

10 Claims, 4 Drawing Figures

FIG. 1
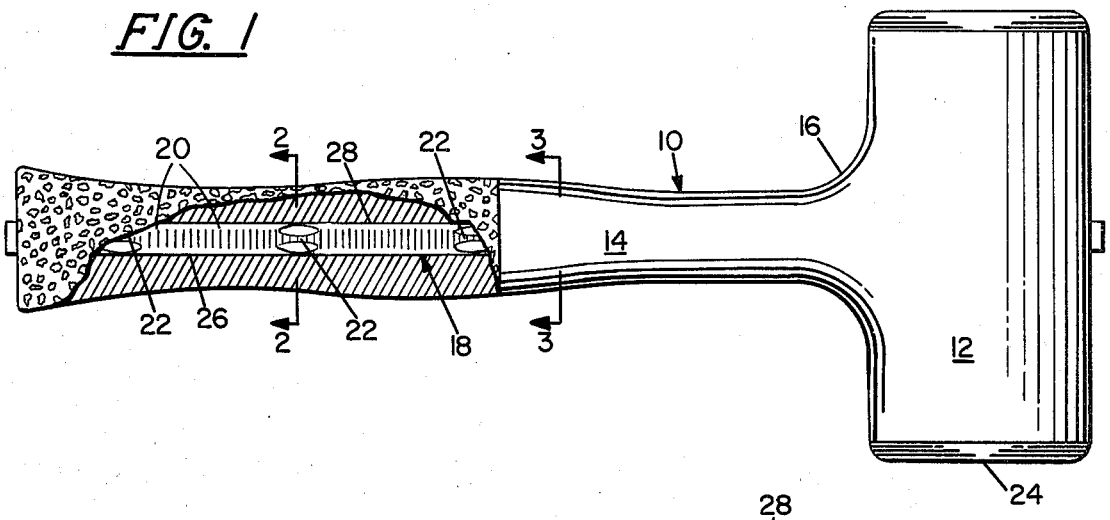
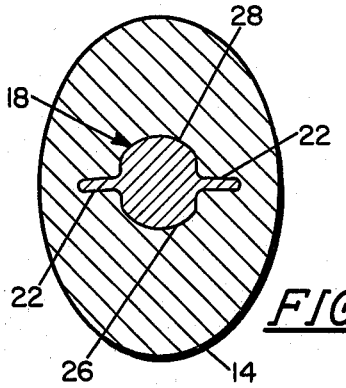
FIG. 2
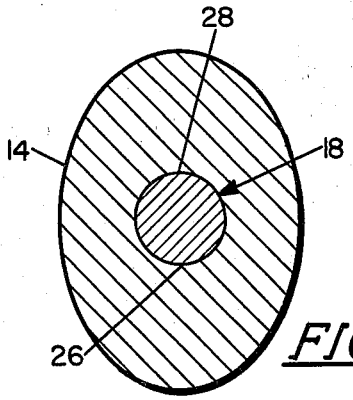
FIG. 3
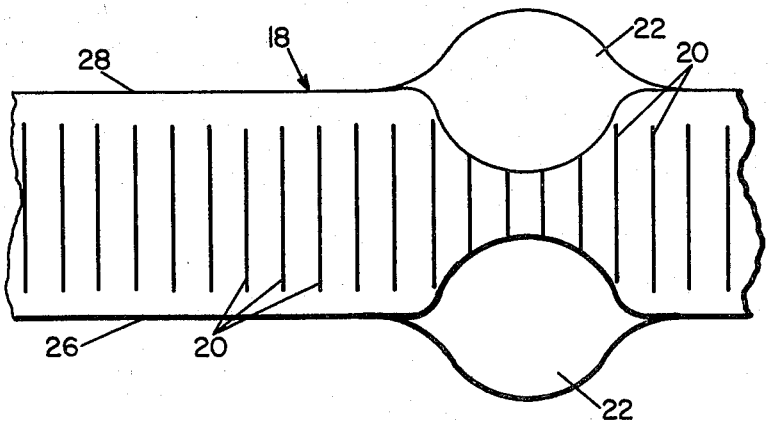
FIG. 4

CAST ALUMINUM ALLOY HAMMER

BACKGROUND OF THE INVENTION

This invention relates to hammers having a so-called "soft" head of multipurpose design used to drive parts without damaging the parts being driven. The heads of such hammers are traditionally composed of relatively soft metals that become deformed in service and use, as opposed to deformation of the part being struck.

The traditional way of making such hammers includes forming a separate head for the hammer and assembling it by various means to a handle, often of a different material (wood or steel). Occasionally, the striking face of the hammer head itself may be removable and replaceable. A wide variety of the soft or relatively soft materials is used and includes soft metals such as copper, zinc, lead, aluminum and their alloys, plastics, rubbers, rawhide, fiber pressed particle and wood material. Even those not well versed in the products available to industry are familiar with the rubber headed hammers used to mount hubcaps on automobiles. The object is to get sufficient weight and momentum in the head of the hammer such that the striking force results in a movement of the articles being struck while at the same time having the face of the hammer head being deformed such that the force of the impact is spread over a larger cross-sectional area which prevents permanent deformation of the article being struck. It is recognized that if the hammer is used on material having a hardness and toughness less than the hammer then the material struck will be deformed.

This invention is relatively limited as compared to the wide variety of uses outlined above in that it is limited to aluminum alloys while the hammer itself may have a wide variety of uses. The hammer of this invention is designed to replace existing aluminum surfaced hammers as it is a superior product in function and is novel as to structure. Copper, brass, lead and the like might be used employing identical structural features.

BRIEF DESCRIPTION OF THE INVENTION

This invention is unique in that it is comprised of a hammer consisting of a one-piece casting which may include a steel rod extending coaxially with the handle of the hammer. As a first consideration it may appear that a hammer of this kind would be uneconomical with respect to the prior art which provides structure for replacing an aluminum alloy hammer head or hammering face by a new head or face when the original is deformed to the extent that it is no longer satisfactorily operable. However, that is no longer true with the costs of labor today. For example, it is more expensive to separately cast an aluminum alloy hammer head and assemble it on a separately cast, machined or formed handle than it is to use the single piece cast aluminum hammer of this invention. Similarly, it is not a cost saving to the user to separately purchase a new head, remove the old head and assemble the new head to the old handle, unless of course labor is free.

Having made this decision, engineering problems arose in the design of the cast hammer of this invention. The prior art discloses cylindrical or other shaped handles extending to a generally barrel shaped hammer head. Because these two parts are separately manufactured and not integral as with a cast one-piece hammer, the problems of cracking at the juncture of the handle and head is not a problem. However, as engineers are well aware, where one has an integral mechanical body under stress, any surface irregularity provides a stress concentration point where the tensions and compressions are magnified and cracks and failures most readily appear. For this reason, a specially designed merging shape was devised for this invention and the result is a smooth curve having no sharp corners in any plane of the merging surface between the head and handle thereby the stress concentrations are minimized.

To further strengthen the hammer, minimize cracks between the handle and head and to prevent industrial accidents by having the handle separate from the head on impact, a rod is provided extending coaxially the length of the handle and through the hammer head. The steel rod is obviously of greater strength than the cast aluminum by a factor of about three.

Having thus described the invention in its simplest terms a detailed description of the invention will follow.

BRIEF DESCRIPTION OF THE DRAWINGS

FIG. 1 is an elevational view of the hammer of this invention partially in section;

FIG. 2 is a sectional view taken along line 2—2 of FIG. 1,

FIG. 3 is a sectional view taken along line 3—3 of FIG. 1,

FIG. 4 is a fragmentary elevational view of the steel rod in the handle of the hammer of FIG. 1.

DESCRIPTION OF THE PREFERRED EMBODIMENT

The hammer of this invention is cast in a sand mold in one piece. It is emphasized that use of a sand mold is critical to get the ductility of the alloy desired. Manufacturing the hammer using a permanent mold allows the hammer to cool too quickly and does not provide the ductility required of hammers designed for the purposes outlined above. It has been stated above that it is most often desirable to have the hammer head striking surface softer than the article being struck such that the hammer impact and momentum are conveyed to the article being struck without any surface deformation of that article. Thus, the need for a more ductile article of manufacture.

Those having ordinary skill in the art have no difficulty in differentiating between alloys cast in a permanent mold and those cast in a sand mold because mechanical tests and microscopic examination of the resulting alloy will illustrate grain-size, etc., relating to ductility, thus the limitation of the product being cast in a sand mold is a characteristic which can be evaluated from an examination of the article itself. An identical hammer cast in a permanent mold is not an acceptable substitute for one manufactured according to the invention disclosed herein. However, the permanent molds might be acceptable to some purchasers, depending upon intended use.

Observing the drawing, the hammer 10 includes a head 12 integrally formed with a handle 14. It will be noted that the area of merger between the handle and the head is defined by a concave surface 16 where the handle diverges outwardly to the surface of the head in a smooth concave surface without any sharp irregularities to cause stress concentration points which would result in a weaker hammer handle. Curves as well as sharp angles serve as stress concentration points in metallic structures under stress and herein reference is to the degree or magnitude of the stress concentration. With the particular smooth curve design illustrated, the stress concentration is greatly minimized as compared to a conventional sharp angles juncture between the handle and the head.

Extending the length of the handle and coaxially therewith is a low-carbon steel rod 18 which serves the purpose of strengthening the handle and the connection between the handle and head. To enhance the bonding or anchoring of the aluminum alloy to the steel rod 18, serrations or surface irregularities 20 are provided in the surface of the rod. As illustrated in FIG. 1 the irregularities are formed on the side surfaces of the cylindrical rod 18. In expressing the location of the irregularities it will be noted that the head 12 has an axis extending normal to the axis of the rod 18 and handle 14; a plane passing through both the axis of the head and the axis of the handle will not pass through any portion of the irregularities 20.

A different irregularity in the form of projections 22 are struck or plastically deformed from the rod material. The reason for the projection 22 is to prevent separation of the head and handle should a crack occur in the cast material. Thus the orientation of the nipples is random. By way of illustration, the projections are differently oriented in FIGS. 1 and 2 then in FIG. 4. For ease of manufacture the serrations are formed first and the nipples next.

The reason for the location of the irregularities is that as a general rule the handle of the hammer will bend in a plane parallel with the arc traversed in the travel of the hammer to the article to be struck. For this reason the more likely points of separation between the rod and surrounding aluminum alloy are on those points of greatest stress during the bending. Assuming the bottom face 24 of the hammer head is to strike the surface to be moved and noting the fact that the steel rod 18 is coaxial with the handle 14, at the greatest bending and flexing of the hammer handle the lower surface 26 (see FIG. 4) of the steel rod will be in tension while the upper surface 28 of the rod will be in compression. Since the serrations 20 are important for a proper bond between the alloy and the rod, they cannot be eliminated. Thus, they have been oriented such that they are at the points of minimum stress on the rod, namely, the sides. The serrations are not located in a place where maximum stress might cause a failure originating at the serration.

It will be noted that the serrations 20 and projections 22 serve another purpose which is to prevent separation of the handle and head should a crack occur between the two. This is a matter of industrial safety in that the most likely time for a hammer head to separate from its handle is in the downward stroke of the head towards the target or immediately after the head has struck the target. The irregularities 20 and 22 will prevent this separation and tus will provide a safer hammer for use in industry.

In the gripping section of the handle a sand-grain textured surface is provided to enhance the gripping by the workmen. Such techniques are well known in the art and in the preferred embodiment the textured surface is coated with an appropriate material to provide easier wiping.

It will be noted that the rod 18 projects slightly beyond the exterior surface of the hammer at each end. These projections anchor the rod in the sand mold as the molten aluminum alloy is being poured. Preferably, the projections are ground off flush with the hammer surface after the molding is completed.

Not just any aluminum alloy is necessarily suitable for use in this context and while the alloy consists essentially of aluminum the following ingredients are incorporated in the percentages indicated:

| | |
|---|---|
| Copper | 0 – 1.00% |
| Zinc | 0 – 0.10% |
| Iron | 0 – 1.80% |
| Silicon | 0 – 0.35% |
| Manganese | 0.10%– 0.35% |
| Magnesium | 6.50% – 8.50% |
| Beryllium | 0 – 0.005% |
| Boron | 0 – 0.001% |
| Titanium | 0.10% – 0.25% |
| Sodium | 0 – 0.002% |
| Nickel | 0 – 0.15% |
| Tin | 0 – 0.15% |

This particular alloy is identified by a plurality of designations, for example, American Society for Metals A-218 or B-218 and under the trade designation ALMAG 35. Aluminum alloys having this composition have the quality of being non-sparking. That is, in using this material one may strike a surface without resulting sparks flying which might ignite flammable fluids in the area, provided iron oxide is not on the surface being struck. The inventor is not exactly sure why sparks do not occur in the absence of iron oxide but the fact is they do not. For this reason, the hammer described herein is much safer in an area where flammable fluids are used.

Having thus described the invention in detail it will be obvious to those having ordinary skill in the art that modifications may be made without parting from the spirit of the invention. It is not the intention of the inventor that the words used to describe the invention herein nor the drawings illustrating the same be limiting on the invention, rather it is intended that the invention be limited only by the appended claims.

I claim:

1. A one piece hammer structure comprising:

integrally cast head and handle portions merging together at a merger area, said head and handle portions each including a longitudinal axis, said axes being generally normal to each other with said merger area being generally centrally disposed on said head portion with said head portion having a generally cylindrical configuration including opposed striking faces disposed generally normal to said head axis;

said handle portion expanding in size adjacent said merger area to define a concave exterior surface merging smoothly with the exterior surface of said head without any sharp angular edges, said concave exterior surface being concave in all planes passing through said handle axis; and, said head and handle portions being comprised of an aluminum alloy having non-sparking characteristics when the head portion is struck against any object target not including iron oxides, said aluminum alloy having the following composition:

| | |
|---|---|
| Copper | 0– 1.00% |
| Zinc | 0– 0.10% |
| Iron | 0– 1.80% |
| Silicon | 0– 0.35% |
| Manganese | 0.10– 0.35% |
| Magnesium | 6.50– 8.50% |
| Beryllium | 0– 0.005% |

-continued

| | |
|---|---|
| Boron | 0– 0.001% |
| Titanium | 0.10– 0.25% |
| Sodium | 0– 0.002% |
| Nickel | 0– 0.15% |
| Tin | 0– 0.15% |

the balance being aluminum.

2. The hammer as defined in claim 1 wherein at least a longitudinal section of said handle portion from the outermost end thereof toward said merger area is heavily textured to establish a gripping section for a user thereof.

3. The hammer as defined in claim 1 further including a reinforcing rod extending longitudinally through said handle portion into said head portion.

4. The hammer as defined in claim 3 wherein said rod comprises a steel rod and includes a plurality of irregularities spaced therealong for anchoring the rod within said hammer.

5. The hammer as defined in claim 4 wherein said rod extends from the outermost end of said handle portion completely through said head portion.

6. The hammer as defined in claim 4 wherein said irregularities comprise a plurality of spaced apart serrations disposed longitudinally along said rod.

7. The hammer as defined in claim 6 wherein said irregularities are located such that a plane passing through said head and handle axes does not intersect said irregularities.

8. The hammer as defined in claim 7 further including a plurality of outwardly extending protrusions disposed at spaced intervals along said rod.

9. A hammer comprising:

integrally formed head and handle portions cast from an aluminum alloy having the following composition:

| | |
|---|---|
| Copper | 0 – 1.00% |
| Zinc | 0 – 0.10% |
| Iron | 0 – 1.80% |
| Silicon | 0 – 0.35% |
| Manganese | 0.10 – 0.35% |
| Magnesium | 6.50 – 8.50% |
| Beryllium | 0 – 0.005% |
| Boron | 0 – 0.001% |
| Titanium | 0.10 – 0.25% |
| Sodium | 0 – 0.002% |
| Nickel | 0 – 0.15% |
| Tin | 0 – 0.15% |

the balance being aluminum;

said head and handle portions each having a longitudinal axis, said portions merging together at a merger area with said head and handle axes disposed generally normal to each other, said handle portion expanding in size adjacent said head portion to define a concave exterior surface merging smoothly with the exterior surface of said head without any sharp angular edges, said handle axis bisecting said head portion and said concave exterior surface being concave in all planes passing through said handle axis;

a steel rod extending generally coaxially through said handle portion into said head portion, said rod including irregularities on the exterior thereof for providing anchoring means between the rod and hammer, said irregularities being located on the surface of said rod whereby a plane passing through both the handle and head axes does not intersect said irregularities.

10. The hammer of claim 9 wherein rod extends from the end of the handle completely through the head.

* * * * *